US009581053B2

(12) United States Patent
Bayrakdar

(10) Patent No.: US 9,581,053 B2
(45) Date of Patent: Feb. 28, 2017

(54) CAMSHAFT ADJUSTMENT DEVICE FOR AN INTERNAL COMBUSTION ENGINE

(71) Applicant: Schaeffler Technologies GmbH & Co. KG, Herzogenaurach (DE)

(72) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/396,006

(22) PCT Filed: Apr. 16, 2013

(86) PCT No.: PCT/EP2013/057878

§ 371 (c)(1),
(2) Date: Oct. 21, 2014

(87) PCT Pub. No.: WO2014/000903

PCT Pub. Date: Jan. 3, 2014

(65) Prior Publication Data

US 2015/0300211 A1 Oct. 22, 2015

(30) Foreign Application Priority Data

Jun. 28, 2012 (DE) ..... 10 2012 211 108

(51) Int. Cl.
*F01L 1/344* (2006.01)

(52) U.S. Cl.
CPC ... *F01L 1/3442* (2013.01); *F01L 2001/34423* (2013.01); *F01L 2001/34453* (2013.01)

(58) Field of Classification Search
CPC ..... F01L 2001/34423; F01L 1/3442
(Continued)

(56) References Cited

U.S. PATENT DOCUMENTS 6,079,382 A 6/2000 Schafer et al.
6,601,554 B1 * 8/2003 Schafer ..... F01L 1/3442 123/90.17

(Continued)

FOREIGN PATENT DOCUMENTS

DE 199 36 632 2/2001
DE 102004024222 3/2005

(Continued)

*Primary Examiner* — Jorge Leon, Jr.
(74) *Attorney, Agent, or Firm* — Davidson, Davidson & Kappel, LLC

(57) ABSTRACT

A camshaft phaser for an internal combustion engine having—a stator (1) driven by a crankshaft of the internal combustion engine; a rotor (3) connected to the camshaft (24) for co-rotation therewith; and working chambers, which are configured between the stator (1) and the rotor (3) and which are subdivided into pressure chambers (A, B) by vanes (18) that are associated with the rotor (3); and—a pressure medium circuit having a plurality of pressure medium channels (A1, B1, C1, E1) that fulfill different functions, at least two of the pressure medium channels (A1, B1, C1, D1) merging into one another in one section (14); and one of the pressure medium channels (A1, B1, C1, D1) being separated in a pressure medium-tight manner from the other pressure medium channel (A1, B1, C1, D1) by a guide sleeve (13) that is inserted into the section (14).

9 Claims, 4 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 6,945,205 | B2 | 9/2005 | Heintzen et al. | |
| 7,954,467 | B2 | 6/2011 | Grunow | |
| 2004/0139937 | A1* | 7/2004 | Ichinosawa | F01L 1/022 123/90.17 |
| 2005/0109298 | A1* | 5/2005 | Bolz | F01L 1/022 123/90.17 |

FOREIGN PATENT DOCUMENTS

| | | |
|---|---|---|
| DE | 102005034275 | 1/2007 |
| DE | 102008030057 | 1/2010 |
| DE | 10 2008 052 275 | 4/2010 |
| DE | 102008057492 | 5/2010 |

* cited by examiner

CAMSHAFT ADJUSTMENT DEVICE FOR AN INTERNAL COMBUSTION ENGINE

The present invention relates to a camshaft phaser for an internal combustion engine.

BACKGROUND

Camshaft phasers are used in modern internal combustion engines to optimize fuel-economy figures and performance data. They serve to variably adjust the opening and closing times of the gas-exchange valves. For that purpose, the camshaft phaser has a stator driven by the crankshaft and a rotor connected to the camshaft for co-rotation therewith. Between the rotor and the stator, working chambers are provided that are able to be acted upon by a pressure medium and that are subdivided by vanes associated with the rotor into reciprocally acting pressure chambers. During operation of the internal combustion engine, both pressure chambers are permanently filled with pressure medium, so that the rotor and the stator are interconnected relatively stiffly. The timing of the gas-exchange valves is then thereby varied by increasing the pressure prevailing in one of the pressure chambers, while decreasing the pressure in the respective other pressure chamber. This requires supplying the pressure medium to the one pressure chamber and conducting it away from the other pressure chamber. To ensure that the system is not set into vibration, the inflow of the pressure medium must generally be controlled by the outflow thereof.

During engine start, the situation can occur where both pressure chambers are only partially filled with pressure medium since the camshaft phaser can drain itself independently via leakage sites. During this time period, the rotor is not hydraulically clamped in the camshaft phaser, so that it can vibrate uncontrollably. To avoid this effect, camshaft phasers are already equipped with a mechanical locking system that couples the rotor to the stator via a fixed mechanical connection. To ensure that the rotor is reliably locked, the locking position corresponds to the limit stop of the rotor relative to the stator either in the timing advance or the timing retard direction.

The German Patent Application DE 10 2008 052 275 A1 describes a camshaft phaser having two hydraulically actuatable locking devices, where the rotor can be locked in a middle position relative to the stator. This requires providing additional pressure medium channels in the camshaft phaser.

In the case of such a camshaft phaser, the relatively costly pressure medium circuit thereof presents a problem that is to be generally resolved. The pressure medium channels must essentially extend over a certain extent in order to form suitable control edges and convey the pressure medium, whereby an installation space problem can arise, in particular at constrictions, since, in any case, the pressure medium channels must be separate from one another to prevent any short-circuiting.

SUMMARY OF THE INVENTION

It is an object of the present invention to provide a camshaft phaser that will allow the pressure medium channels to be configured even under very restricted installation-space conditions, without any risk of the pressure medium flows short-circuiting.

The present invention provides a camshaft phaser for an internal combustion engine, having

- a stator driven by a crankshaft of the internal combustion engine;
- a rotor connected to the camshaft for co-rotation therewith; and
- working chambers, which are configured between the stator and the rotor and are subdivided into pressure chambers by vanes associated with the rotor; and
- a pressure medium circuit having a plurality of pressure medium channels that fulfill different functions; the basic idea of the present invention being that
- at least two of the pressure medium channels merge into one another in one section and that one of the pressure medium channels be separated in a pressure medium-tight manner from the other pressure medium channel by a guide sleeve that is inserted into the section.

The design approach of the present invention makes it possible to substantially simplify the pressure medium circuit, even in a restricted installation space, since the pressure medium channels are thereby able to merge into one another, at least in sections, thus be able to be formed by a common pressure medium channel, the separation of the pressure medium flows then being realized by the inserted guide sleeve. The inserted guide sleeve may then be virtually considered to be a continuation of one of the pressure medium channels in the common section, so that the pressure medium flows are again separated from one another in a pressure medium-tight manner even in the common section of the pressure medium channels. The guide sleeve may be formed as a simple separating wall. It is merely important that inserting the guide sleeve again divides the common section of the pressure medium channels into two sections that are separated from one another in a pressure medium-tight manner.

A hydraulically actuatable locking device is provided in accordance with the present invention that is able to be acted upon by a pressure medium in a pressure medium channel extending in one section through the rotor, the pressure medium channel associated with the locking device merging transitionally in one section into the pressure medium channel associated with one of the pressure chambers and being sealed in a pressure medium-tight manner in the section by the guide sleeve. The inventive approach is particularly advantageous since, in terms of fluid mechanics, it is especially difficult to connect the hydraulic locking device, which is able to be acted upon by a pressure medium via a pressure medium channel configured in the rotor, to the pressure medium circuit. This is because the pressure medium channel in the rotor is preferably connected to the pressure medium circuit in a radially inner section due to the rotational mobility of the rotor. Also, the pressure medium channels of the pressure chambers extend toward the pressure chambers, likewise starting out from the radially inner side of the rotor. Thus, together with the adjoining components, the radially inner side of the rotor forms an extremely restricted installation space within which the pressure medium channels must be configured. Especially problematic in terms of fluid mechanics is connecting the pressure medium channel of the locking device, that extends through the rotor, past the pressure medium channels of the pressure chambers.

The present invention also provides that the pressure medium channel associated with the locking device be formed in a first section by an end-face bore in the camshaft, and, in a second section, by a pressure medium channel in the rotor, and, in terms of fluid mechanics, that the first and the second section be interconnected by the guide sleeve. Thus, the guide sleeve forms a pressure medium-tight connection of the two sections of the pressure medium channels, so that it is continued by the actually common section of the pressure medium channels and is separated in a pressure tight-manner from the other pressure medium channel.

Another preferred specific embodiment of the present invention provides that the guide sleeve extend into the pressure medium channel of the rotor and couple the rotor to the camshaft by positive engagement and for co-rotation therewith. Thus, the guide sleeve may be simultaneously used as an element that fixes the rotor in co-rotation with the camshaft. In the related art, this is also referred to as "timing spin," and it is required by various vehicle manufacturers.

It is also provided that that section, in which the pressure medium channels merge into one another, be larger than the guide sleeve, and that a free space be provided laterally of the guide sleeve through which the pressure medium of the respective other pressure medium channel flows past along the guide sleeve. Thus, the guide sleeve does not completely fill the common section in the cross section of the flow direction, so that a cross-sectional area remains free for the pressure medium flow of the other pressure medium channel.

It is also provided that the guide sleeve rest laterally against a wall in that section in which the pressure medium channels merge into one another. Thus, the guide sleeve is laterally supported in the common section of the pressure medium channels, so that it, itself, is loaded to a lesser degree should a transversal loading occur.

It is also provided that the guide sleeve be formed by a tube. It is advantageous to use a tube as a guide sleeve since the tube itself is already a part that is radially outwardly pressure medium-tight and that only needs to be connected by the open ends thereof to the respective sections of the pressure medium channels.

It is also provided in this case that the tube be configured in parallel to the longitudinal axis of the camshaft. The guide sleeve may thereby be preferably located in a wall of the camshaft in parallel to the longitudinal axis thereof. This is particularly advantageous since, in this section, the camshaft is designed to be tubular and to include a central bolt that engages into the camshaft, and, for that reason, the wall constitutes a smaller cross-sectional area for configuring the guide sleeve in which the guide sleeve may be mounted in an installation space-saving manner due to the configuration provided.

It is also provided that the guide sleeve be joined in a press-fit connection to the camshaft and/or the rotor. The connection provided is an especially cost-effective type of connection that is suited for high-volume production and that fully suffices here for the acting forces.

BRIEF DESCRIPTION OF THE DRAWINGS

The present invention is clarified in the following with reference to the figures, in each of which are readily apparent in detail.

DETAILED DESCRIPTION

Figure 1:
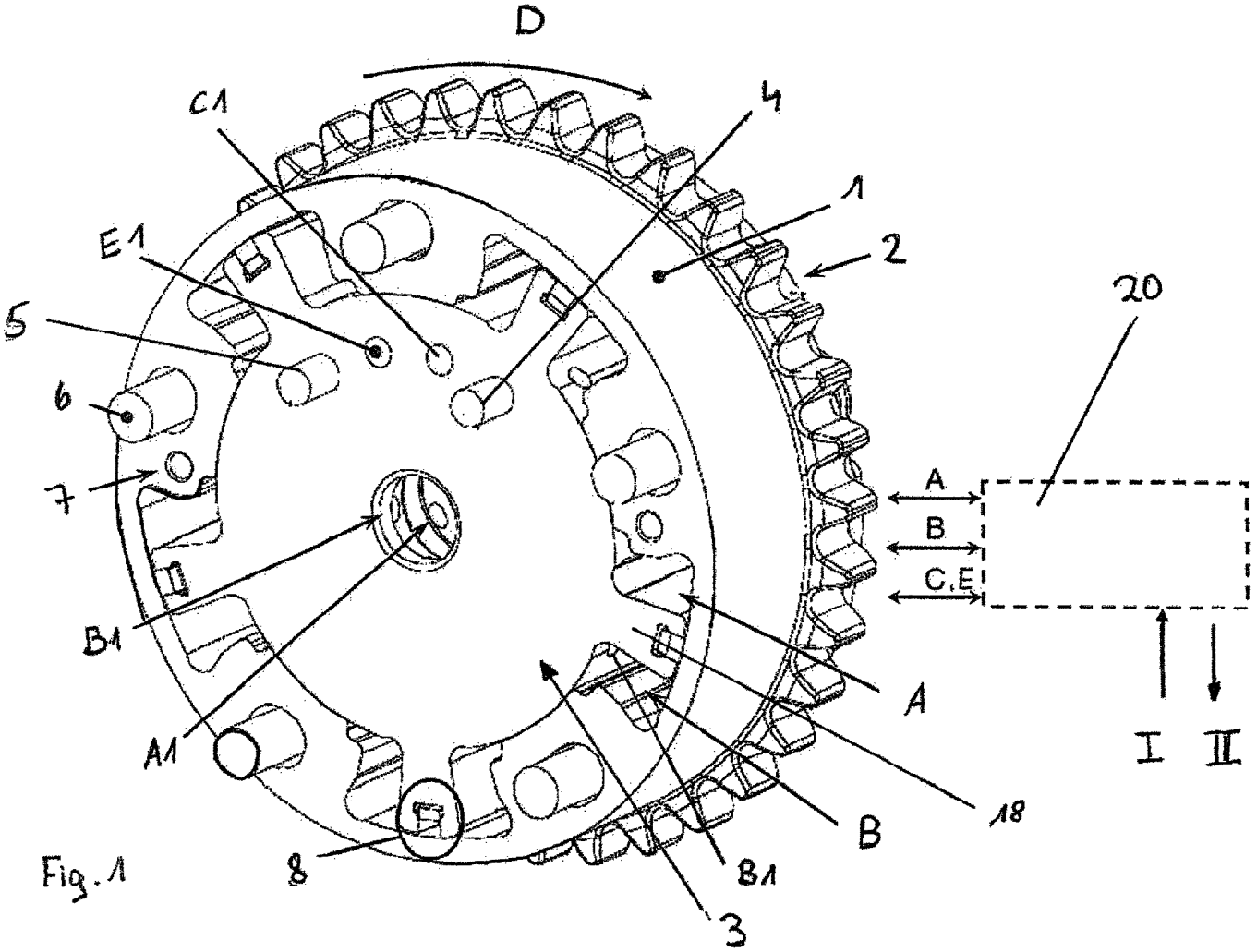
FIG. 1: a camshaft phaser with a view of the rotor and the stator.

The camshaft phaser according to the present invention having a symbolically illustrated control unit 20 is discernible in FIG. 1. The camshaft adjusting device has a basic design that is known in the related art and includes a crankshaft-driven stator 1 and a rotor 3 that is connected to a camshaft for co-rotation therewith. On the outside thereof, stator 1 has a toothing 2 into which engages a drive chain that transmits the rotary motion of the crankshaft in direction of rotation "D." Stator 1 is provided with radially inwardly directed projections that subdivide the hollow space between stator 1 and rotor 3 into working chambers. In addition, the working chambers are divided by vanes 18 configured on rotor 3 into pressure chambers A and B, vanes 18 being braced by the radial outer side thereof via seals 8 against stator 1. In rotor 3, pressure medium channels A1 and B1 are provided that, in response to control unit 20, are acted upon by a pressure medium from an oil pump "I" via a central valve 21 that is discernible in FIG. 3, respectively that conduct the pressure medium away into a tank "II." Pressure medium channels A1 and B1 lead into pressure chambers A and B; in response to oil pump "I" acting on one of the pressure chambers A or B, the pressure medium being conducted away from respective pressure chamber A or B, which is not acted upon by the pressure medium, into tank "II."

Figure 2:
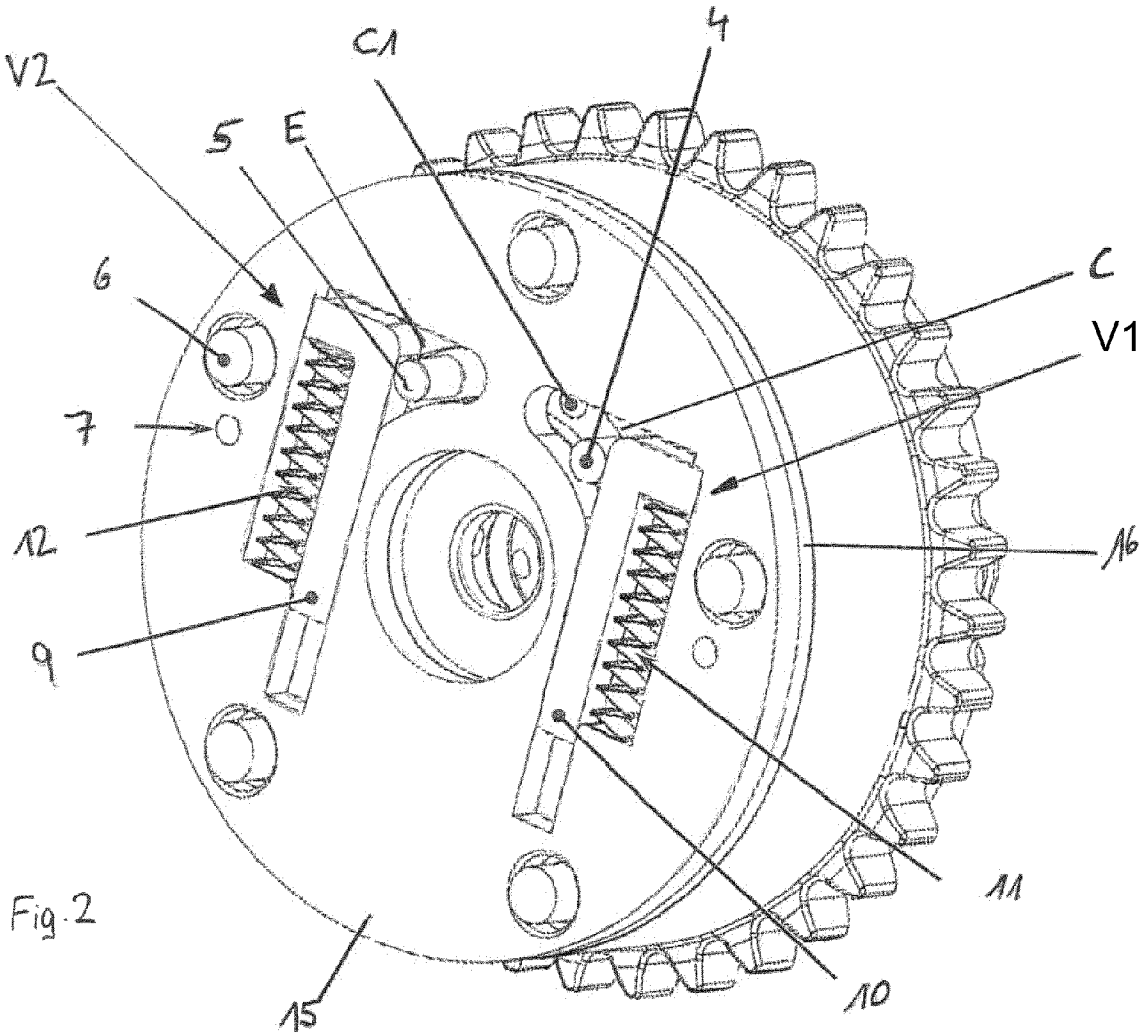
FIG. 2: a camshaft phaser including a center locking device.

Discernible in FIG. 2 is the camshaft phaser having an intermediate cover 15 which is configured on front sealing cover 16 and in which locking devices V1 and V2 are located. Each locking device V1 and V2 is composed of a locking element 4, 5, an arresting device 9, 10, and a pressure chamber C and E. Arresting devices 9 and 10 are formed by longitudinally displaceably guided pistons and are spring-loaded by springs 11 and 12 into the locking position illustrated in FIG. 2. Pressure medium channels C1 and E1 discharge into pressure chambers C and E to unlock locking devices V1 and V2; pressure medium channel E1 not being discernible due to the perspective representation. As a general principle, pressure medium channels C1 and E1 may be connected by a common control line to a control valve and a common discharge line to tank "II," since the pressure medium always acts only jointly on pressure chambers C and E of adjusting devices V1 and V2.

Figure 3:
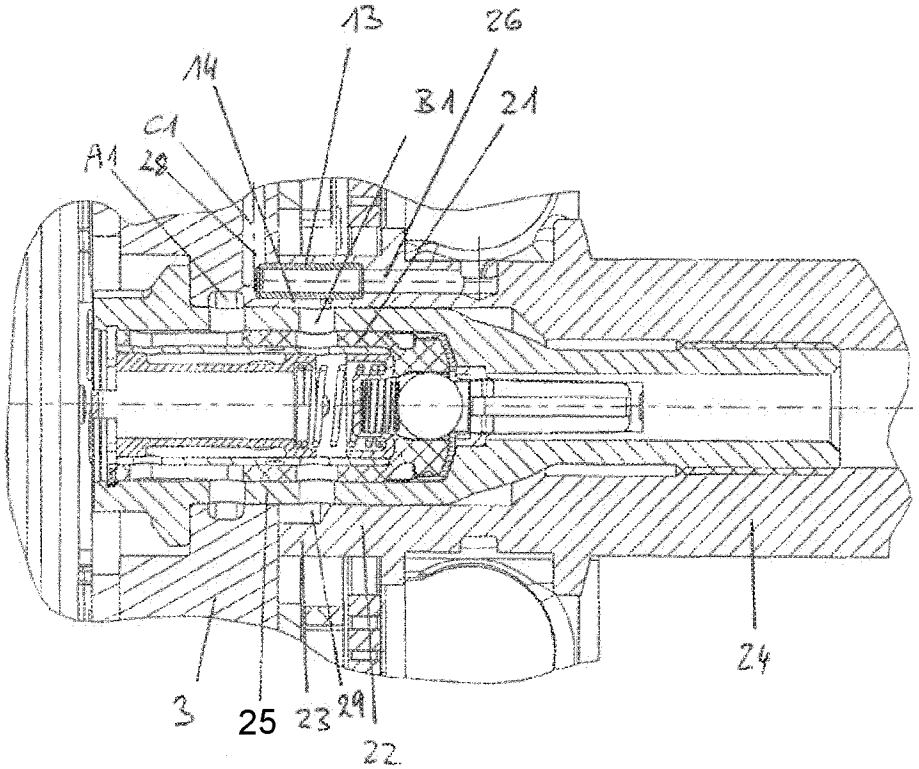
FIG. 3: a central valve having a central bolt and a camshaft.

The camshaft phaser including rotor 3, which is rotatably mounted in stator 1, front sealing cover 16, intermediate cover 15, a front cover and rear sealing cover (not shown) is entirely assembled using five bolts 6, which are distributed over the periphery, and two centering pins 7. In the basic design thereof, the described camshaft phaser corresponds to that described in the German Patent Application DE 10 2008 052 275 A1 which is to be expressly added to the disclosure of this invention for the understanding thereof Discernible in FIG. 3 is camshaft 24 including rotor 3 and central bolt 25. At least in the illustrated end portion, camshaft 24 has a tubular form, including a first annular section 22 and a second annular section 23 and an internal thread into which central bolt 25 is screwed. Central bolt 25 has a bolt head 19 and penetrates a middle opening in rotor 3, thereby clamping rotor 3 between bolt head 19 and the end face of camshaft 24.

In the illustrated detail, pressure medium channels A and B extend in various through holes of central valve 21 and of central bolt 25 and into an annular space on the inner side of rotor 3 and into an annular space 29 formed by second annular section 23 having a smaller wall thickness than first annular section 22. Second annular section 23 has an outside diameter that is identical to second annular section 22, but a smaller inner diameter, whereby radially inner annular space 29 is formed. Pressure medium channel C1, which, in this section, is identical to pressure medium channel E1, is formed in a first section by a bore 26 in annular sections 22 and 23 that is oriented in parallel to the longitudinal axis of camshaft 24 and, in a second section, is formed as an L-shaped bore 28 in rotor 3. Bore 26 leads into annular space 29, so that pressure medium channels C1 and B1 merge into one another in a common section 14 that is constituted of a partial section of annular space 29. To ensure that pressure medium channels B1 and C1 and the pressure medium flows contained therein are nevertheless separate from one another, a guide sleeve 13 is provided that is pressed into bore 26 and is dimensioned in length in a way that allows it to project beyond the end face of camshaft 24, as is also discernible in FIG. 4, and project into L-shaped bore 28.

During assembly, rotor 3 is fitted via the opening of L-shaped bore 28 onto the protruding end of guide sleeve 13, whereby rotor 3 is simultaneously fixed in a predefined orientation relative to camshaft 24 for co-rotation therewith. Thus, guide sleeve 13 simultaneously forms the rotationally fixed connection of camshaft 24 to rotor 3 required by various vehicle manufacturers that is also referred to as "timing spin." Guide sleeve 13 bridges section 14 and thereby virtually forms a pressure medium-tight continuation of pressure medium channel C1, starting from bore 26, continuing through annular space 29 and to bore 28, making it possible to separate pressure medium channels C1 and B1 from one another in a pressure medium-tight manner in section 14 of annular space 29 and prevent any short-circuiting of pressure medium flows.

Figure 4:
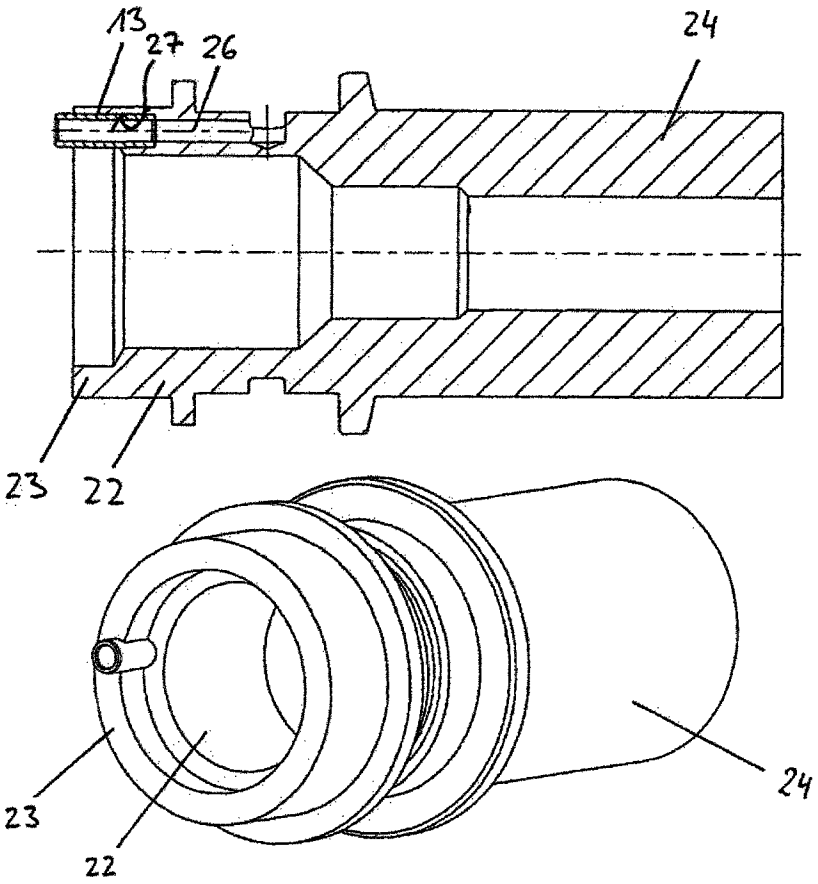
FIG. 4: a camshaft having a guide sleeve in a sectional representation and oblique view.

Discernible in FIG. 4 is the end of camshaft 24 including the two annular sections 22 and 23. Discernible in first annular section 22 is bore 26 which continues as a groove on a wall 27 of second annular section 23. Guide sleeve 13 is pressed into bore 26 and rests laterally on wall 27 in the groove. In the assembled state, guide sleeve 13 is unsupported radially inwardly toward annular space 29.

Since it is essential that second annular section 23 have a thinner wall thickness than first annular section 22 in order to form annular space 29 of pressure medium channel B1, the available wall thickness of second annular section 23 no longer suffices for continuing bore 26 in a pressure tight-manner in second annular section 23 as well. This disadvantage is overcome by the present invention in that guide sleeve 13 is inserted in a subsequent process, and in that pressure medium channel C1 is closed by guide sleeve 13 from bore 26 toward bore 28, again in a pressure medium-tight manner.

In spite of the small installation space, pressure medium channels B1 and C1 may be separated from one another in a pressure medium-tight manner by guide sleeve 13 that is provided. This makes it possible to considerably simplify the design of the pressure medium circuit, which is particularly advantageous here with regard to intersecting pressure medium channels B1 and C1. Guide sleeve 13 is configured here as a short tubular section. However, it would also be conceivable to only configure guide sleeve 13 as a separating wall, provided that this suffices for a pressure medium-tight separation of pressure medium channels B1 and C1.

LIST OF REFERENCE NUMERALS

1 stator
2 toothing
3 rotor
4 locking device
5 locking device
6 bolts
7 centering pins
8 seals
9 arresting device
10 arresting device
11 spring
12 spring
13 guide sleeve
14 section
15 intermediate cover
16 sealing cover
17 front cover
18 vane
19 guide contour
20 control unit
21 central valve
22 first annular section
23 second annular section
24 camshaft
25 central bolt
26 bore
27 wall
28 bore
29 annular space
A1, B1, C2, E2 pressure medium channels
A, B, E, C pressure chambers
V1, V2 locking devices

What is claimed is:

1. A camshaft phaser for an internal combustion engine comprising:

a stator driven by a crankshaft of the internal combustion engine;

a rotor connected to the camshaft for co-rotation therewith; and working chambers configured between the stator and the rotor and subdivided into pressure chambers by vanes associated with the rotor; and a pressure medium circuit having a plurality of pressure medium channels fulfilling different functions, at least two of the pressure medium channels merging into one another in one section; and one of the pressure medium channels separated in a pressure medium-tight manner from the other pressure medium channel by a guide sleeve inserted into the one section, the guide sleeve having a guide sleeve longitudinal axis parallel to, but offset from, a longitudinal axis of the camshaft.

2. The camshaft phaser as recited in claim 1 further comprising a hydraulically actuatable locking device actable upon by a pressure medium in one of the pressure medium channels extending in a section through the rotor, the pressure medium channel associated with the locking device merging transitionally in the one section into one of the pressure medium channels associated with one of the pressure chambers, and being sealed in a pressure medium-tight manner in the one section by the guide sleeve.

3. The camshaft phaser as recited in claim 2 wherein the pressure medium channel associated with the locking device is formed in a first section by an end-face bore in the camshaft, and, in a second section, by a pressure medium channel in the rotor; and, in terms of fluid mechanics, the guide sleeve interconnects the first and the second section.

4. The camshaft phaser as recited in claim 3 wherein the guide sleeve extends into the pressure medium channel of the rotor and couples the rotor to the camshaft by positive engagement and for co-rotation therewith.

5. The camshaft phaser as recited in claim 1 wherein the one section is larger than the guide sleeve; and a free space is provided in the one section laterally of the guide sleeve, a pressure medium of the respective other pressure medium channel flowing past and along the guide sleeve through the free space.

6. The camshaft phaser as recited in claim 1 wherein the guide sleeve rests laterally against a wall in the one section.

7. The camshaft phaser as recited in claim 1 wherein the guide sleeve is formed by a tube.

8. The camshaft phaser as recited in claim 1 wherein the guide sleeve is joined in a press-fit connection to the camshaft or the rotor.

9. The camshaft phaser as recited claim 1 further comprising a central bolt, the pressure medium circuit passing through the central bolt.

* * * * *